US007163442B2

(12) United States Patent
Jacquorie et al.

(10) Patent No.: US 7,163,442 B2
(45) Date of Patent: Jan. 16, 2007

(54) METHOD OF MAKING MICRO TITER PLATES AND MICRO TITER PLATES MADE THEREBY

(75) Inventors: Michael Jacquorie, Heidesheim (DE); Markus Vos, Ingelheim (DE)

(73) Assignee: Schott AG, Mainz (DE)

( * ) Notice: Subject to any disclaimer, the term of this patent is extended or adjusted under 35 U.S.C. 154(b) by 547 days.

(21) Appl. No.: 10/390,118

(22) Filed: Mar. 17, 2003

(65) Prior Publication Data

US 2003/0211014 A1 Nov. 13, 2003

(30) Foreign Application Priority Data

Mar. 20, 2002 (DE) ..... 102 12 266

(51) Int. Cl.
*B24B 7/24* (2006.01)

(52) U.S. Cl. ..... 451/28; 451/910; 451/165; 83/27; 83/956; 422/102

(58) Field of Classification Search ..... 422/102, 422/128; 83/956, 27; 408/700, 408; 264/442; 156/73.1, 3, 580.1, 2; 451/28, 165, 910
See application file for complete search history.

(56) References Cited

FOREIGN PATENT DOCUMENTS

| | | |
|---|---|---|
| DE | 197 36 630 A1 | 3/1999 |
| DE | 197 40 806 A1 | 4/1999 |

OTHER PUBLICATIONS

Brochure From the Radlegs Company, Essex, United Kingdom, 1997: Specialist Micro Titer Plates & Accessories.
Article "Laeppen" (Lapping), APA, (With Certified English Translation).

*Primary Examiner*—Jill Warden
*Assistant Examiner*—Natalia Levkovich
(74) *Attorney, Agent, or Firm*—Michael J. Striker

(57) ABSTRACT

The micro titer plates, especially for micro reaction systems used in biotechnology, each have an array of special microstructures, which typically include micro cups and micro channels with different cross-sections. These microstructures are introduced into a preferably borosilicate glass wafer (18) by ultrasonic machining. Individual rectangular micro titer plates (19') made from borosilicate glass for biotechnology are produced by cutting the structured glass wafer into individual micro titer plates. Particularly arrays of from 10 to 100 of these microstructures are formed in a 6-inch borosilicate glass wafer, in order to facilitate subsequent cutting of the wafer to economically manufacture a corresponding number of these micro titer plates (19').

9 Claims, 4 Drawing Sheets

FIG. 1
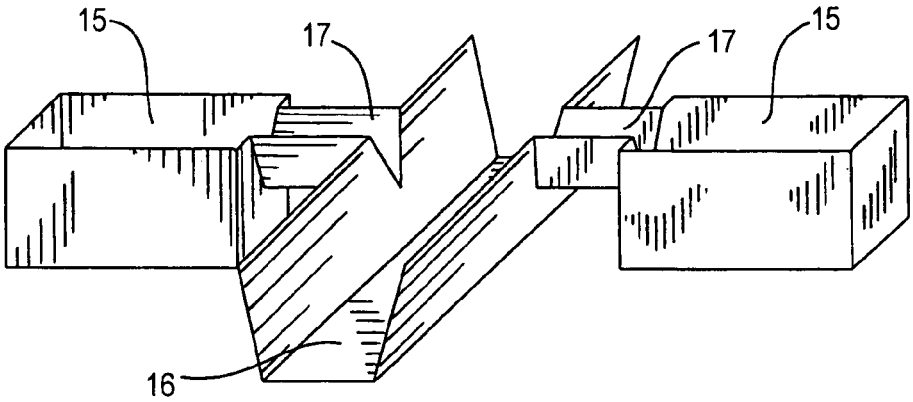
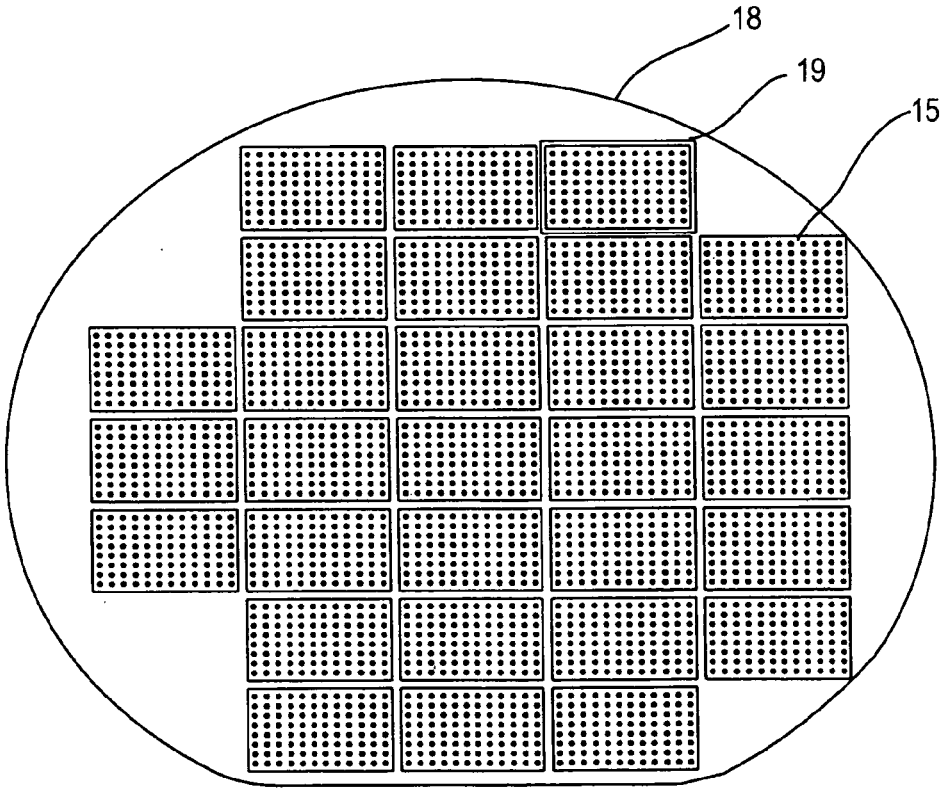
FIG. 2

METHOD OF MAKING MICRO TITER PLATES AND MICRO TITER PLATES MADE THEREBY

BACKGROUND OF THE INVENTION

1. Field of the Invention

The present invention relates to a method of making microtiter plates, which each have an array of microstructures, comprising at least microcups. The invention also relates to a microtiter plate.

2. Description of the Related Art

Microtiter plates, which are known from numerous disclosures, e.g. DE 197 36 630 A1 or DE 197 40 806 C2, are plate-shaped base bodies provided with a plurality of very small reaction chambers. The reaction chambers, also called cavities or cups, are arranged in rows and columns to form a multi-cellular or honeycomb structure. The smallest amount of a liquid sample, for example of blood for diagnosis of medicinal parameters or diseases detectable in blood or water for monitoring water quality, are put in each reaction chamber. During the testing a chemical or biological reaction or the like takes place, which is accompanied by a coloration or discoloration of the liquid samples. The color change resulting from the reaction is usually monitored optically or electro-optically. For this latter reason the microtiter plates are constructed from a transparent material.

The word part "titer" in the words "microtiter plate" originates or is derived from titration analysis, in which it is defined as the content of a dissolved reagent in a standard solution.

The micro titer plates are provided with cavities of different diameters, for example in a range of from 3 to 7 mm. Typically they have dimensions of 120 mm×80 mm.

It is known to make microtiter plates composed of glass or transparent plastic. Microtiter plates composed of glass have little self-fluorescence as well as high chemical resistance and thus a great service life. They are very difficult to manufacture with conservative methods and thus quite expensive. Significant breakage danger and thus only very limited design possibilities exist for microtiter plates made of glass, as is the case with all glass products. Furthermore the tolerances attainable with glass, which depend on material and process conditions, are very much poorer than with typical injection molded plastic materials.

Micro titer plates composed of plastic are of course easy to make, e.g. by micro-injection molding. However they have very limited chemical resistance, especially to organic solvents, and little heat resistance. Furthermore the transparency of the cavity bottoms is limited to short wavelength light, so that optical determinations of the results of treatment or reaction are limited to only or dependent on UV light.

Micro titer plates have a special importance in biotechnology. Since the start of the nineties micro reaction systems for biotechnology, in which processes, such as measuring, mixing, synthesizing and analyzing of biochemical reactions are performed, have been investigated. The efficient and flexible employment of these systems in comparison to traditional macroscopic laboratory components and structures is significant, especially in the case of the micro titer plate. Biotechnology in recent years is thus one of the fastest growing and most innovative application areas for micro technology.

Microtiter plates like these micro reaction systems are used for rapid parallel high throughput tests (abbreviated HTS) for analysis of biochemical reactions by means of interferometry and fluorescence spectroscopy. Known microtiter plates of this type typically have 96 1.536 microcups with volumes in the pl to μl range on a total microtiter plate surface area of less than 100 $cm^2$. The material cost factor in analyses of pharmaceutical, bio- and genetic engineering products can be significantly reduced because of the small reaction volumes. Also the large number of parallel tests leads to rapid and economical analysis. The n×m microcups are arranged in arrays with grid numbers of (n'×8)×(m'×12). The grid width between the microcups amounts to up to a few millimeters. The individual microcups can be uniformly and simultaneously filled with reaction participants by means of capillary action through micro channels. The micro channels have channel widths and depths greater than 50 μm. The microcups are filled in parallel with other reaction partners. This parallel filling occurs by means of transfer systems, which comprise a base plate with an appropriate number of rods. The rods are dipped in the reagents. A definite amount of material adheres to the rod tips by adhesion. The transfer of material occurs by dipping the rod tips with the material adhering on them in the microcups. An additional method for filling the microcups makes use of the principle of ink-jet printers instead of the rods.

The material selected for making the micro reaction systems depends particularly on the chemical and thermal material properties. The importance of borosilicate glass as the standard material for making macroscopic systems is carried over in micro reaction technology. Besides high chemical and heat resistance in comparison to most plastics, which lead to a long service life for the micro titer plates, these glasses have a higher degree of transmittance in the UV, VIS and IR spectral ranges in comparison to metals and ceramics. This is an important prerequisite for spectral analysis of chemical reactions. Glass characterized by very little self-fluorescence is suitable for fluorescence spectroscopy analyses, which are often performed in micro titer plates. Borosilicate glass acting as an insulating material allows the future automation of processes in a micro titer plate by combination of micro reaction structures with microelectronic elements in the glass substrate.

Photolithography combined with etching is the dominant process used for making the foregoing microtiter plates from glass. Photolithography is based on the preparation of a contour mask with detailed microstructure. The blank for the contour mask comprises a quartz glass substrate with a chromium absorber layer and an overlying radiation-resistant photo resist layer. The photo resist is partially irradiated with electron, ion or laser radiation according to the desired detailed microstructure and subsequently developed. The processing time for the irradiation of the photo resist can amount to several hours according to the mask size and required resolution. When a positive resist is used the irradiated regions are subsequently dissolved chemically from the surface. When a negative resist is used the regions which are not irradiated are dissolved chemically from the surface. During subsequent etching the photo resist portions remaining on the surface act as an etching stop, whereby the scaled microstructure is produced in the Cr-absorber layer. By removing ("stripping")the remaining photo resist the contour mask required for the microstructuring is produced. After that the structure on the contour mask is transferred on the substrate covered with photo lacquer. This process corresponds to the irradiation during the manufacture of the contour mask, in which the irradiation times are considerably reduced in comparison to the mask manufacture.

Material is removed from the glass substrate by means of wet chemical, RIE- or dry etching methods. HF or an $HF/H_2SO_4$ acid mixture is used for wet chemical etching, while RIE- and dry etching are performed exclusively with fluorine compounds. During isotropic wet chemical etching the ingredients of the glass network are converted into fluorides by HF or into sulfates by $H_2SO_4$ at temperatures of 15° C.<T<70° C. and dissolved uniformly from the network. Large aspect ratios are not possible because of the isotropy of the wet chemical etching and because of under etching under the photo lacquer. Anisotropic etching can be achieved in RIE and dry etching methods by using passivating layers for protection of the not removed substrate regions and by preferred directions in irradiation dependent excitation of the etching processes. The etching processes can make exactly shaped microstructures with surface roughness $R_a$<10 nm. The structure depth for microchannels with nearly perpendicular edges amounts to <25 μm. However when the etching speed or rate is large the mask/substrate selectivity of the etching and the exactness of the formed structures deteriorate so that the RIE etching rate for silicate glass is usually in range from 50 to 100 nm/min.

These processes are usually very expensive because of the large number of treatment steps.

A laser irradiation process, which is especially suited for prototype, small-scale and medium-scale production of microtiter plates, is an additional known method for making microtiter plates. Structures are produced in the in-range with material removal rates $R_{Abl}$=150 nm/pulse with the VUV laser radiation (wavelength $\lambda_L$=157 nm) of an $F_2$ excimer laser. The proportion of photochemical material removal is larger than with long-wavelength laser radiation because of the large photon energy $E_{Ph}$=7.9 ev. This clearly reduces the melt deposition at the structured edges. The wavelength and the nonuniform local power density distribution of the laser radiation for that require considerable effort for guiding and forming the beam in a vacuum system. The manufacture of optics with sufficient service life is also a problem.

The small pulse energy of the $F_2$ laser beam, $E_P$=60 mJ, in comparison to ArF and KrF excimer laser beams permits small surface area static mask projection methods. Exactly formed microstructures are made with UV excimer laser beams with wavelengths of $\lambda_L$=193 nm (ArF), 248 (KrF) and 308 nm (XeCl) depending on the processed glass material. The removal rates $R_{Abl}$ are in a size range between $R_{Abl}$>50 nm/pulse ($\lambda_L$=193 nm) and $R_{Abl}$<6 nm/pulse ($\lambda_L$=308 nm). Lateral structure dimensions of a several tens of micrometers are achieved. Especially with microstructuring with laser radiation of wavelength $\lambda_L$=193 nm exact microstructures are formed in borosilicate glass, while at larger excimer laser wavelengths with pulse durations in the ns range the structural precision is influenced by fissures and conchoidal fractures in the glass. Micro holes with aspect ratios>1:1 and diameters>200 μm are made with ArF and KrF excimer laser radiation in different silicate glasses. Material is removed by laser beams in the visible wavelength range, e.g. copper vapor laser beams ($\lambda_L$=511 nm and $\lambda_L$=578 nm) and dye laser beams ($\lambda_L$=615 nm), with large pulse peak power densities with ultra short pulse duration or with large average pulse power with large repetition rates. In the visible range particularly pulse duration in the femto second and pico second range and a power density in a range of $p_L>10^{12}$ W/cm$^2$ are used. The probability of two-photon absorption is increased at this power density of the femto second and pico second pulse. The interaction of the laser beam with the expanding plasma is decreased with the femto second and pico second pulse. The resulting large photochemical material removal leads to less melt release with removal rates of $R_{Abl}$=400 nm/pulse in sodium-potassium silicate glass. Laser beams with pulse duration in the nanosecond range and repetition rates>1 kHz in quartz glass and borosilicate glass are used to make micro holes with aspect ratios<50:1 and diameters of greater than 200 μm.

Sources for laser beams with ultra short pulse duration are complex to handle and commercially available sources for these laser beams are limited in their availability. Material removal by laser beams in the IR range was tested with Nd:YAG laser beams ($\lambda_L$=1.064 nm) and $CO_2$ laser beams ($\lambda_L$=10.6 λm). Q-switched $CO_2$ lasers are used e.g. for marking glass surfaces. The removal rates of the photochemical material removal with a $CO_2$ laser beam reach values of $R_{Abl}$=2 to 3 μm$^2$/pulse. The achievable structural accuracy is however not sufficient for making microtiter plates, since considerable removal of melt occurs at the structure edges and fissures and fractures arise because of the photochemical material removal.

The method using laser beam removal is thus unsuitable for solution of the problem of economical large-scale manufacture of microtiter plates.

Conventional metal-working manufacturing methods, such as ultraprecision turning or milling, rapidly approach performance limits in regard to making complex microstructuros, such as microtiter plates.

SUMMARY OF THE INVENTION

It is an object of the present invention to provide an economical process for making microtiter plates from glass, especially in regard to formation of the microstructures in the microtiter plates.

According to the invention this object is attained by a method of making microtiter plates from glass comprising the steps of:

a) preparing a glass wafer of chemically resistant glass, whose surface area is a multiple of the surface area of an individual one of the micro titer plates to be made;

b) forming microstructures in the glass wafer by ultrasonic machining with at least one forming tool; and c) after the forming of the microstructures, cutting the microstructured glass wafer into individual micro titer plates of predetermined dimensions.

Surprisingly the ultrasonic machining is outstandingly suitable for performing the microstructuring of the micro titer plates in a glass substrate with an adequate manufacturing time. The micro titer plates can be made in an economical manner from glass because of the formation of a plurality of micro titer plates on a single glass wafer.

According to a preferred embodiment of the invention the glass wafer is composed of borosilicate glass. This type of glass guarantees that the micro titer plate according to the invention can be used in a large number of different applications. However it is also conceivable that the micro titer plates can be made from potassium-sodium glass, which has a high resistance to acid gases. A cerium stabilized glass is preferred for applications in which the brown/gray glass color of the micro titer plate, which occurs when the micro titer plates are sterilized with γ radiation, would be troublesome.

The ultrasonic machining permits formation of a number of different microstructures in the micro titer plates. According to one embodiment of the method the micro cups are formed in the glass wafer by drilling by ultrasonic machining methods, i.e. by ultrasonic drilling.

Alternatively or in addition the microstructures are formed in the glass wafer with at least one forming tool, which has a negative contour or shape corresponding to that of the microstructure to be formed, by means of ultrasonic machining, i.e. ultrasonic sinking.

Finally in a preferred embodiment the microstructures are produced by ultrasonic machining in such a way that the forming tool is quided in a plane in which the glass wafer extends during working of the glass wafer according to the shape of the microstructure to be formed. This embodiment is called ultrasonic channel machining.

Two diverse strategies can be used to produce the microstructures in the micro titer plates formed from the glass wafer.

In the first strategy a method is used in which the entire microstructures of all of the microtiter plates to be formed in the glass wafer are made with a suitable flat forming tool. In this first embodiment of the method the forming of the microstructures takes place comparatively rapidly. However the cost of making the flat large-scale forming tool with contours adapted to form the entire microstructures is comparatively high.

Alternatively a method is also useable in which the microstructures of all the micro titer plates formed from the glass wafer are each formed one after the other with suitable linear forming tools. In this case the manufacturing time is substantially longer than in the case of the first strategy, but the cost of making the linear forming tools is considerably less.

According to the size of the microtiter plates, i.e. the number of microstructures, one or the other of the two strategies is the more economical.

An embodiment of the method according to the invention for making the microtiter plates is preferred, in which besides the microcups primary channels are formed in rows extending between the microcups and, arranged transversely to the primary channels, secondary channels are formed connecting neighboring microcups with the primary channels. An embodiment of the method according to the second strategy can be used in which the microcups are formed in a first method step by ultrasonic drilling, the primary channels are formed in a second step by ultrasonic sinking and the secondary channels connecting the microcups and the primary channels are formed in a third step.

New economically manufactured microtiter plates made of glass, preferably borosilicate glass, are another aspect of the present invention. These microtiter plates are formed by the techniques of ultrasonic machining.

A particularly preferred embodiment of these microtiter plates has a microstructure in which primary channels are formed in parallel rows between the microcups and secondary channels are formed transversely to the primary channels, which connect neighboring microcups with the primary channels and each other. This embodiment facilitates a particularly rapid filling of the microcups with reagents or the like.

BRIEF DESCRIPTION OF THE SEVERAL VIEWS OF THE DRAWING

The objects, features and advantages of the invention will now be described in more detail with the aid of the following description of the preferred embodiments, with reference to the accompanying figures in which:

FIG. 1 is a perspective cutaway view of a microstructure of a microtiter plate according to the invention in a borosilicate wafer, which comprises two microcups with a square cross-section and which is provided with a primary channel with a trapezoidal cross-section and with two secondary channels with V-shaped cross-sections for filling the microcups by means of capillary action;

FIG. 2 is a plan view of a 6-inch borosilicate wafer with 28 microtiter plates each having 96 microcups;

DETAILED DESCRIPTION OF THE INVENTION

To make microstructures with complex shapes, as is the case with microtiter plates, as the ultrasonic machining according to the invention machining with geometrically defined cutting edges is used. The ultrasonic machining is performed according to DIN 8589, which describes the milling with geometrically defined cutting edges in part 15, machining. This standard states that ultrasonic machining is defined as follows: ultrasonic machining is machining with loose grains distributed uniformly in a paste or liquid (machining mixture), which obtain momentum from a generally shape transmitting object (machining tool) oscillating with frequencies in the ultrasonic range, which gives them working power.

Ultrasonic machining provides an effective method for working highly solid and brittle materials, such as glass, for micro-structuring applications. That only very small forces need be applied for working is a decisive advantage. Particularly this aspect puts the user in a position to produce cavities or depressions with diameters below 1 mm to work thin substrates with a thickness of 200 μm to 1 mm.

The property of cracking of brittle materials under mechanical load as a result of advancing fracture formation was the starting point for the use of the ultrasonic machining according to the invention. The ultrasonic machining for making the micro titer plates this undesirable behavior is aimed for and utilized in a controlled fashion.

Figure 8:
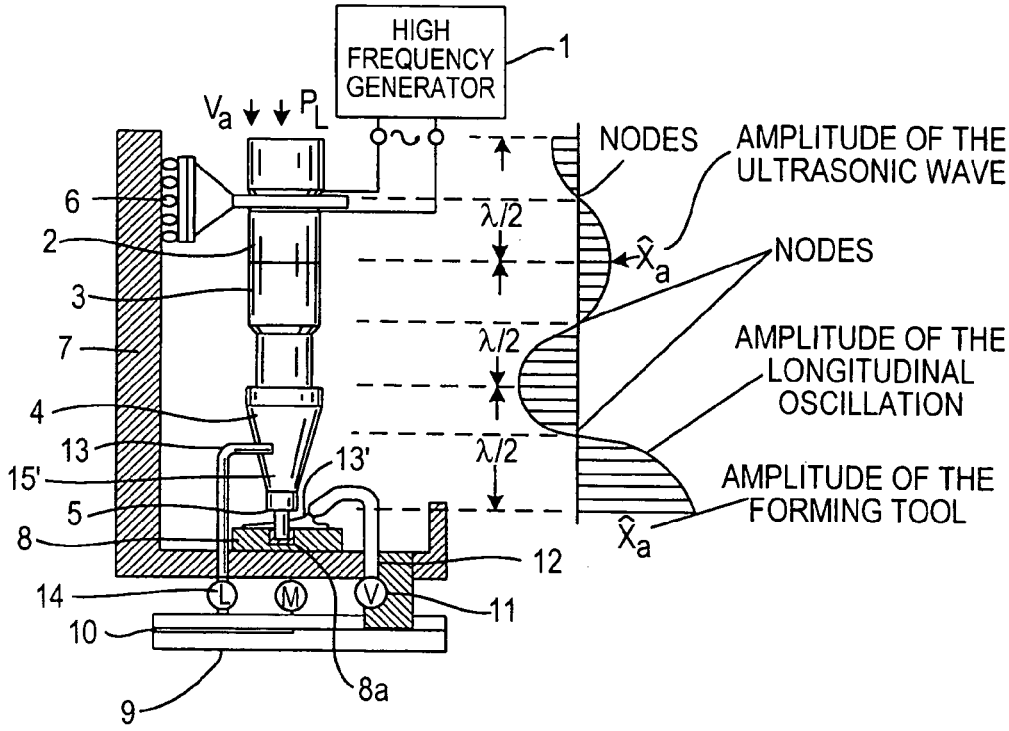
FIG. 8 PRIOR ART
FIG. 8 is a schematic longitudinal cross-sectional view illustrating the principles of ultrasonic machining using a known ultrasonic machining apparatus.

The method of ultrasonic machining with the known ultrasonic machining apparatus shown in FIG. 8 will now be explained in general terms.

The high frequency generator 1 produces an electrical alternating voltage, which is converted in ultrasonic transducer 2 into mechanical oscillations of equal frequency. While in the past the magnetostrictive effect was predominantly used to produce mechanical longitudinal oscillations in the ultrasonic frequency range (19 to 23 kHz), currently piezoceramic ultrasonic transducers are used. The oscillation amplitudes occurring at the outputs of these transducers are about 5 to 15 μm. Since these amplitudes are mostly too small for machining purposes, they must be amplified further in the following components comprising transformer 3 and sonotrode 4. In industrial practice working amplitudes are sought between 20 and 30 μm. The sonotrode 4 is the holder for the machining tool, an amplitude amplifier and means for resonant adjustment of the entire oscillating system.

The machining tool 5, also known as the "forming tool", is mounted in the front surface of the sonotrode. It is connected with the sonotrode by a solder connection, partially also by a conical press connection and an adhesive joint. Together with the transducer the transformer, the sonotrode and forming tool form an oscillating or vibrating system, which is held guided in a frame base 7 by means of a Z-guide 6. The workpiece 8, here a glass wafer, is clamped on the frame base 7. So that the assembled unit can resonate, each part must be tuned to a half wavelength ($\lambda/2$) or n.$\lambda$ of the excitation frequency in order to minimize losses during conversion of the oscillation energy. The vertical machining pressure $P_L$ and a force for advancing at a certain feed speed $V_a$ act all at once.

The actual material removal occurs by supplying a machining agent suspension, which comprises water and hard grains, i.e. primarily boron carbide or silicon carbide granulates, slurried in it. This suspension is contained in a reservoir 9 with a motorized stirring mechanism 10. The feeding of the suspension occurs by means of a suspension pump 11 and a suspension feeder 12 with a laterally arranged nozzle 13'. The conveying from the cavity 8*a* in the workpiece 8 occurs by the forming tool motion. Furthermore, when the geometry allows the cavities or depressions to be produced, the suspension is fed back into the reservoir 9 through a passage 15' in the forming tool 5 and the sonotrode 4 by suction through a suction tube 13 produced by a suction pump 14.

At the start of machining the machining granulate is loose between the workpiece 8 and the machining tool 5. The machining granulate is pushed on the surface of the workpiece to be processed by the high frequency longitudinal oscillation of the tool 5 and is thereby effective in machining the workpiece. The physical process consists essentially of hammering the boron carbide or silicon carbide grains into the workpiece surface. Because of that action cracks are induced in the workpiece in the smallest microscopic regions, which add up over time and space leading to a removal of material.

Different shapes of the machined cuts can be made with the ultrasonic machining technique.

Ultrasonic machining techniques include the so-called ultrasonic drilling. Similar drilling or cutting power as that obtained with diamond drills can be obtained by drilling with the help of ultrasonic machining techniques with optimized process guidance. Furthermore additional after-processing steps, such as milling the drill hole entrance sides, can be eliminated when ultrasonic drilling is used. There is almost no lower limit for drill hole diameters in ultrasonic drilling in contrast to drilling with a diamond drill. While drill hole diameters less than 2 mm can scarcely be obtained with conventional diamond drills, tool diameters of 0.2 mm are used in ultrasonic drilling.

Besides the above-described making of simple holes, another form of ultrasonic machining based on the image forming character of ultrasonic machining permits the sinking in of arbitrary shapes, also called "ultrasonic sinking". In this form of ultrasonic machining the forming tool has the negative contour of the miorostructure to be formed.

With the help of a further new type of process, differing from the imaging principle, track or path machining can be performed. In an extension of the ultrasonic sinking method, the so-called "ultrasonic channel machining" makes formation of large-scale arbitrarily shaped surfaces with dimensions of several millimeters to centimeters possible. Forming tool 5 and workpiece 8 are maneuvered relative to each other during machining in the plane of the workplace surface in order to follow the contour or shape of the microstructure to be formed. By means of ultrasonic channel machining, one the other hand, the range of applications of the ultrasonic machining is considerably increased and, on the other hand, the possible geometric shapeds for the parts produced are considerably improved. Besides the great flexibility of this embodiment of the method, it has proven to be especially advantageous that the time consuming and cost intensive manufacture of contour adjusted forming tools is eliminated.

Figure 3:
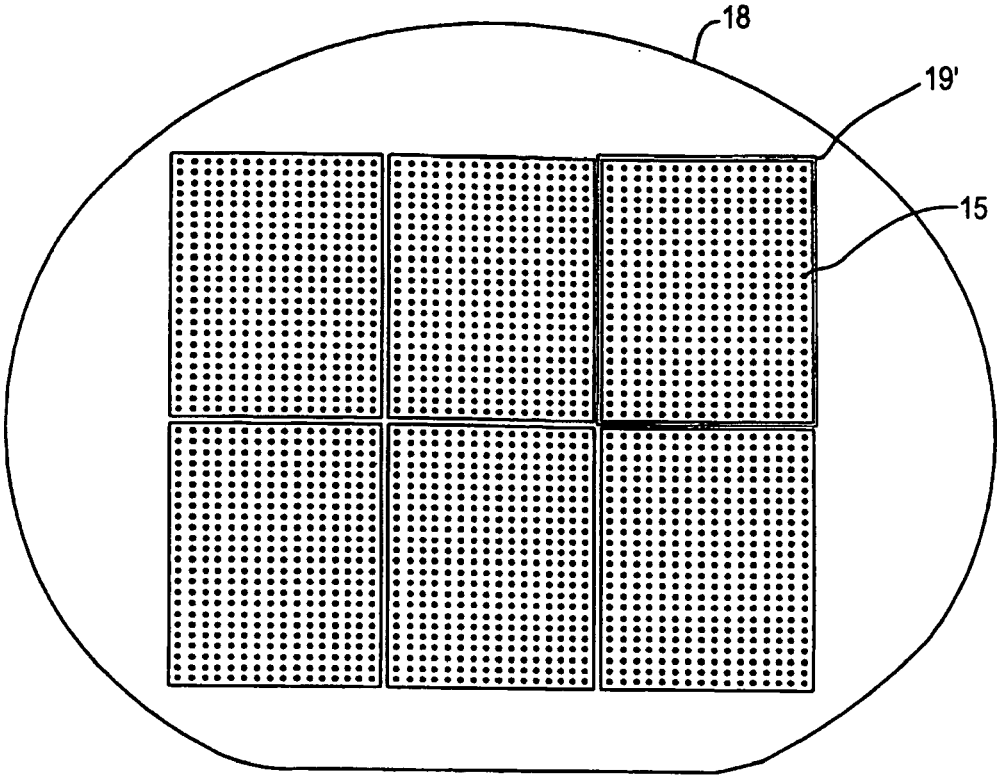
FIG. 3 is a plan view of a 6-inch borosilicate wafer with six microtiter plates with 384 cups each.

FIG. 1 shows an advantageous embodiment of a microstructure according to the invention in a glass wafer. Microtiter plates essentially comprise microcups. The cups can be filled simultaneously and uniformly when liquid substances are conducted through microchannels (in the following designated "primary channels") between the microcups. The liquid substances can flow by capillary action from the primary channels through connecting channels (in the following designated "secondary channels") connecting the primary channels with the microcups. The embodiment of the structure is shown cutaway in FIG. 1 with two microcups 15 and one primary channel 16 and two secondary channels 17 with typical dimensions of 0.4 mm. The illustration according to FIG. 1 is to be understood as cutout from an array of several, i.e. 10 to 100, microcups as shown in FIGS. 2 and 3. These microcups are arranged in pairs to the left and right of a primary channel and are connected with each other and the primary channel by secondary channels. The cross-section of the microcups can be circular or square. Likewise the cross-sections of the primary and secondary channels can be trapezoidal and V-shaped respectively, as can be understood from FIG. 1.

By means of a special forming tool the array shown cutaway in FIG. 1 can now be introduced into the surface of the glass wafer, especially into the surface of a borosilicate glass wafer, by successive ultrasonic machining or grinding procedures. A 6-inch borosilicate glass wafer according to the invention is illustrated in FIGS. 2 and 3.

FIG. 2 shows a 6-inch wafer 18 with 28 micro titer plates 19 with 96 micro cups 15 each. For simplification only the micro cups are shown in the micro titer plates in FIG. 2. The size of a micro titer plate amounts to 1.7 cm×2.5 cm with a grid spacing of 2 mm. The dimensions of the micro cups are:

| | |
|---|---|
| volume | 0.5 μl |
| diameter | 0.8 mm |
| depth | 0.5 mm. |

FIG. 3 shows an embodiment of a 6-inch wafer 18 with 6 microtiter plates 19'. Each microtiter plate 19' has 384 cups. The size of a microtiter plate 19' amounts to 3.3 cm×4.9 cm with a grid spacing of the cups of 2 mm. The dimensions of the microcups correspond to those of FIG. 2.

For introduction of the microstructures into the glass wafer 18 two different strategies are available for machining or working the wafer.

Figure 4A:
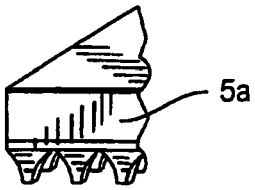
FIGS. 4A, 4B and 4C are cutaway perspective views of different embodiments of flat forming tools for making micro cups, primary channels and secondary channels respectively.
Figure 4B:
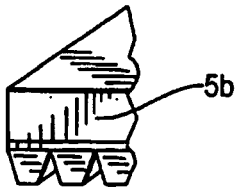
Figure 4C:
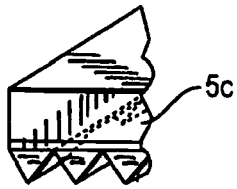

1. The first strategy comprises full-surface machining of the glass wafer 18 by means of ultrasonic sinking with flat forming tools according to FIG. 4 in the dimensions of the wafer. These forming tools contain the complete negative structures for the microcups, primary channels and secondary channels or combinations of these structures (e.g. cups and primary channels in a single forming tool). The shape-adjusted, full-surface forming tools can be made from steel, e.g. by microerosion. FIG. 4A shows a forming tool 5*a* for forming the microcups 15. FIG. 4B shows a forming tool 5*b* for forming the primary channels 16 and FIG. 4C shows a forming tool 5*c* for forming the secondary channels 17 (FIG. 1).

Figure 5:
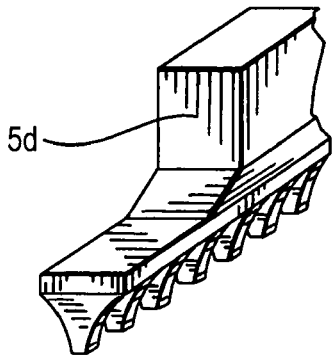
FIG. 5 is a perspective view of a linear forming tool for making square microcups by ultrasonic drilling.
Figure 6:
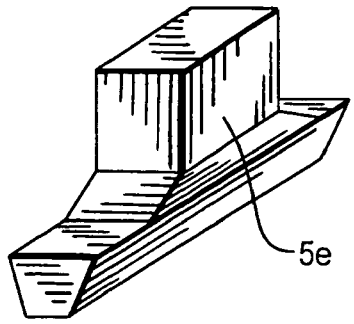
FIG. 6 is a perspective view of a linear forming tool for making primary channels by means of ultrasonic machining.
Figure 7:
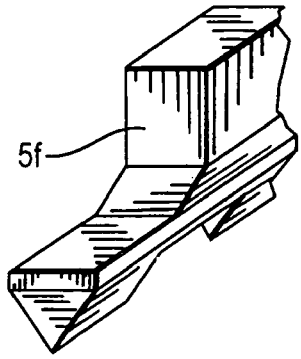
FIG. 7 is a perspective view of a linear forming tool for making secondary channels.

2. The second strategy comprises machining of the water by means of ultrasonic drilling, ultrasonic groove or channel machining and ultrasonic sinking with linear forming tools. FIG. 5 is a cutaway view of a linear forming tool 5*d* for making square or rectangular microcups 15 by means of ultrasonic drilling. FIG. 6 is a cutaway perspective view of linear forming tool 5*e* for making primary channels 16 by means of ultrasonic channel machining. FIG. 7 is a perspective cutaway view of a linear forming tool 5*f* for making secondary channels 17 by means of ultrasonic sinking.

The linear microstructures are introduced row by row into the glass surface.

The working of the wafer by means of ultrasonic sinking with flat forming tools according to the first strategy (strategy 1) allows the machining work to be reduced by about a factor of 50 to 60 (corresponding to the number of rows introduced to form the microstructure) in comparison to the ultrasonic drilling/ultrasonic channel machining/ultrasonic sinking according to strategy 2. The work required to make the flat forming tool for ultrasonic sinking by strategy 1 is however correspondingly greater than the effort required to make the linear forming tools.

The machining of the wafers according to FIGS. 2 and 3 by strategy 2 will now be described to illustrate the manufacturing method for micro titer plates, which comprise an array of several, i.e. 10 to 100, of the above-described microstructures.

In a first machining step the micro cups 15 are formed in the surface of the 1-mm thick glass wafer 18 in a grid with a grid spacing of e.g. 2 mm and to a depth of e.g. 0.5 mm. By the grid spacing or length the surface area of the preferred resulting micro titer plates 19 or 19' in the embodiments with 96 cups (surface area: 1.7 cm×2.5 cm) or 384 cups (surface area: 3.3 cm×4.9 cm) and the number of micro titer plates 19, 19' are set on the 6-inch glass water 18.

A linear forming tool somewhat different from that shown in FIG. 5 is used to make circular or round cross-sectioned micro cups. This latter forming tool has a plurality of individual needles in a linear array.

In the second machining step the primary channels 16 (FIG. 1) are introduced into the surfaces between the micro cups 15 by means of ultrasonic channel machining. Also a special forming tool 5*c* according to FIG. 6 is used to introduce the primary channels 16 channel-for-channel into the glass wafer 18.

In the third and final machining step the secondary channels 17 are introduced by ultrasonic sinking into the glass surface in such a manner that an array comprising the microstructure shown in FIG. 1 is produced. In this machining step a special forming tool 5*f* according to FIG. 7 is employed.

The micro titer plates 19 or 19' arise now by cutting the glass wafer 18 into the individual pieces shown in FIGS. 2 and 3. Under the circumstances a terminal after-working is required by polishing the glass surfaces.

The disclosure in German Patent Application 102 12 266.0-52 of Mar. 20, 2002 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of making micro titer plates and micro titer plates made thereby, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method of making microtiter plates from glass, said method comprising the steps of:

a) providing a glass wafer of chemically resistant glass;

b) ultrasonic machining of said glass wafer with at least one forming tool so as to form an array of microstructures in said glass wafer, said microstructures each including a number of microcups; and c) after the forming of the microstructures in the glass wafer, cutting said glass wafer apart into individual microtiter plates of predetermined dimensions, said individual microtiter plates each including a plurality of said microcups.

2. The method as defined in claim 1, wherein said chemically resistant glass is a borosilicate glass.

3. The method as defined in claim 1, wherein said microcups are formed in said glass wafer by ultrasonic drilling.

4. The method as defined in claim 1, wherein said microstructures are sunk in said glass wafer with said at least one forming tool by ultrasonic sinking and said at least one forming tool has a negative contour corresponding to a contour of said at least one of the microstructures to be produced.

5. The method as defined in claim 1, wherein said microstructures are formed by ultrasonic machining with said at least one forming tool while guiding said at least one forming tool in a plane in which said glass wafer rests during the ultrasonic machining according to a contour of the microstructures to be produced.

6. The method as defined in claim 4, wherein said at least one forming tool comprises flat forming tools, said microstructures of all of said microtiter plates are formed in said glass wafer with said flat forming tools, and said flat forming tools are formed for formation of said microcups, primary channels, and secondary channels connecting said microcups with said primary channels.

7. The method as defined in claim 1, wherein said microstructures of all of said microtiter plates are formed in said glass wafer one after the other with said at least one forming tool, and said at least one forming tool comprises linear forming tools for forming the microstructures.

8. The method as defined in claim 1, wherein said microstructures comprise said microcups, which are formed in said glass wafer by ultrasonic drilling in a first ultrasonic machining step, primary channels formed in said glass wafer in rows between said microcups by ultrasonic channel machining in a second ultrasonic machining step, and secondary channels connecting the microcups with the primary channels, and said secondary channels are formed in a third ultrasonic machining step.

9. The method as defined in claim 1, wherein besides said microcups a plurality of primary channels extending in rows between said microcups is formed in said glass wafer by ultrasonic channel machining and a plurality of secondary channels, which are arranged transverse to said primary channels and which connect said microcups and said primary channels, is formed by ultrasonic sinking.

* * * * *